US009413085B2

(12) United States Patent
Hoppmann et al.

(10) Patent No.: US 9,413,085 B2
(45) Date of Patent: Aug. 9, 2016

(54) ELECTRICAL CONNECTION TERMINAL

(71) Applicant: PHOENIX CONTACT GMBH & CO. KG, Blomberg (DE)

(72) Inventors: Ralph Hoppmann, Bad Oeynhausen (DE); Martin Gebhardt, Porta Westfalica (DE)

(73) Assignee: PHOENIX CONTACT GMBH & CO. KG, Blomberg (DE)

( * ) Notice: Subject to any disclaimer, the term of this patent is extended or adjusted under 35 U.S.C. 154(b) by 0 days.

(21) Appl. No.: 14/407,481

(22) PCT Filed: Jun. 6, 2013

(86) PCT No.: PCT/EP2013/001662
§ 371 (c)(1),
(2) Date: Dec. 12, 2014

(87) PCT Pub. No.: WO2013/185893
PCT Pub. Date: Dec. 19, 2013

(65) Prior Publication Data

US 2015/0162671 A1 Jun. 11, 2015

(30) Foreign Application Priority Data

Jun. 15, 2012 (DE) ..... 10 2012 011 794

(51) Int. Cl.
*H01R 4/48* (2006.01)

(52) U.S. Cl.
CPC ..... *H01R 4/4854* (2013.01); *H01R 4/4836* (2013.01)

(58) Field of Classification Search
CPC ..... H01R 4/4818; H01R 4/4845
USPC ..... 439/441, 835
See application file for complete search history.

(56) References Cited

U.S. PATENT DOCUMENTS 4,846,722 A 7/1989 Heng et al.
8,113,858 B1 * 2/2012 Chiang ..... H01R 4/4845 439/188

(Continued)

FOREIGN PATENT DOCUMENTS

AU 2003270937 A1 * 7/2004 ..... H01R 4/4845
DE 3830442 C2 3/1989

(Continued)

OTHER PUBLICATIONS

Notice of Reasons for Rejection, Japanese Patent Office, Nov. 2, 2015, pp. 1-2.

*Primary Examiner* — Abdullah Riyami
*Assistant Examiner* — Thang Nguyen
(74) *Attorney, Agent, or Firm* — Leydig, Voit & Mayer, Ltd.

(57) ABSTRACT

An electrical connection terminal includes a housing having a conductor insertion opening, a busbar disposed in the housing, and a spring element rotatably mounted in the housing and pivotable into an open position and into a closed position. In the closed position, a conductor inserted into the conductor insertion opening is clampable against the busbar via the spring element. The electrical connection terminal includes an actuating element which is rotatably mounted in the housing. The actuating element includes an actuating arm via which the spring element is configured to actuate so as to be transferred into the open position and into the closed position. The actuating element comprises a clearance adapted to the spring element into which the spring element is pivots during a pivot movement from the closed position into the open position, without triggering a rotational movement of the actuating element.

7 Claims, 5 Drawing Sheets

(56) References Cited

U.S. PATENT DOCUMENTS

| | | | | |
|---|---|---|---|---|
| 8,129,641 | B2 * | 3/2012 | Majewski | H01R 4/4836 200/335 |
| 8,444,443 | B2 * | 5/2013 | Schafmeister | H01R 4/4836 439/441 |
| 8,475,191 | B2 * | 7/2013 | Schafmeister | H01R 4/4836 439/266 |
| 9,240,650 | B2 * | 1/2016 | Wu | H01R 4/48 |
| 2005/0245114 | A1 * | 11/2005 | Shiga | H01R 13/6295 439/157 |
| 2010/0116634 | A1 | 5/2010 | Majewski et al. | |
| 2011/0223795 | A1 | 9/2011 | Schafmeister | |

FOREIGN PATENT DOCUMENTS

| | | | |
|---|---|---|---|
| DE | 4408985 | A1 | 9/1994 |
| DE | 69703829 | T2 | 7/2001 |
| DE | 10103187 | A1 | 7/2002 |
| DE | 202005010991 | U1 | 11/2006 |
| DE | 102008039868 | A1 | 3/2010 |
| EP | 2234212 | A1 | 9/2010 |
| JP | 48041291 | | 6/1973 |
| JP | 60200474 | A | 10/1985 |
| JP | 2000243480 | A | 9/2000 |
| WO | WO 0031830 | A1 | 6/2000 |

* cited by examiner

ELECTRICAL CONNECTION TERMINAL

CROSS-REFERENCE TO RELATED APPLICATIONS

This application is a U.S. National Phase application under 35 U.S.C. §371 of International Application No. PCT/EP2013/001662, filed on Jun. 6, 2013, and claims benefit to German Patent Application No. DE 10 2012 011 794.9, filed on Jun. 15, 2012. The International Application was published in German on Dec. 19, 2013, as WO 2013/185893 A1 under PCT Article 21 (2).

FIELD

The invention relates to an electrical connection terminal comprising a housing having a conductor insertion opening, a busbar arranged in the housing, a spring element which is rotatably mounted in the housing and is pivotable into an open position and into a closed position, it being possible, in the closed position, to clamp a conductor inserted into the conductor insertion opening against the busbar by means of the spring element, and having an actuating element which is rotatably mounted in the housing, has an actuating arm and by means of which the spring element can be actuated so as to be transferred into the open position and into the closed position.

BACKGROUND

DE 10 2008 039 868 A1 discloses an example of an electrical connection terminal, in which a spring element formed as a leg spring can be pivoted, by means of an actuating element, into an open position and a closed position in order to clamp a conductor inserted into the housing. To open the spring element and to thus facilitate the pivoting of the spring element out of the closed position into the open position, the actuating element comprises an actuating wall and two unlocking portions formed laterally next to the actuating wall. When the spring element is pivoted out of the closed position into the open position, the actuating wall can enter a slot formed in the spring element. To pivot the spring element completely from the closed position into the open position, the actuating element has to be moved upwards and thus itself pivoted or rotated. In this case, the actuating wall of the actuating element slides through the slot in the spring element until the end of the actuating wall hits, from the inside, a leg of the spring element, so that when the actuating element is pivoted further, the spring element is also pivoted into the open position.

A drawback here is that, owing to the pivot movement or rotational movement of the actuating element when the spring element is transferred from the closed position into the open position, the user is at great risk of injury since, in particular with high spring forces, a large force acts on the actuating element and thus the actuating element is rotated at high speed in an uncontrolled manner. If the actuating element is actuated by a tool, the risk of injury to the user is additionally increased in the process, since the tool pivots therewith in a fast and uncontrolled manner.

SUMMARY

In an embodiment, the present invention provides an electrical connection terminal comprising a housing having a conductor insertion opening, a busbar disposed in the housing, and a spring element rotatably mounted in the housing and pivotable into an open position and into a closed position.

In the closed position, a conductor inserted into the conductor insertion opening is clampable against the busbar via the spring element. The electrical connection terminal includes an actuating element which is rotatably mounted in the housing. The actuating element includes an actuating arm via which the spring element is configured to actuate so as to be transferred into the open position and into the closed position. The actuating element comprises a clearance adapted to the spring element into which the spring element is pivots during a pivot movement from the closed position into the open position, without triggering a rotational movement of the actuating element.

BRIEF DESCRIPTION OF THE DRAWINGS

The present invention will be described in even greater detail below based on the exemplary figures. The invention is not limited to the exemplary embodiments. All features described and/or illustrated herein can be used alone or combined in different combinations in embodiments of the invention. The features and advantages of various embodiments of the present invention will become apparent by reading the following detailed description with reference to the attached drawings which illustrate the following.

DETAILED DESCRIPTION

Figure 1:
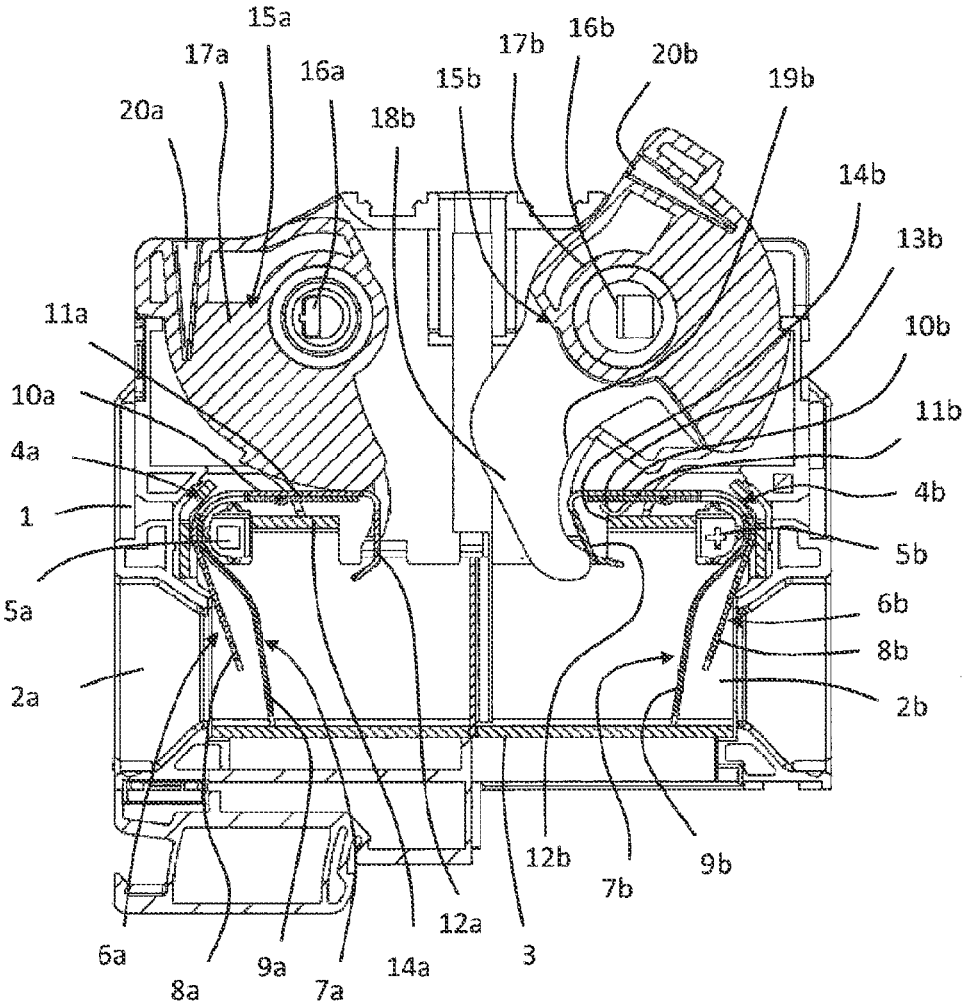
FIG. 1 is a schematic sectional view of an electrical connection terminal according to the invention.

An aspect of the invention provides an electrical connection terminal in which the risk of injury to the user when transferring the spring element from a closed position into an open position can be significantly reduced.

An electrical connection terminal according to the invention is provided in which the actuating element comprises a clearance which is adapted to the spring element and into which the spring element can pivot during a pivot movement from the closed position into the open position, without triggering a rotational movement of the actuating element.

The invention is thus characterised in that the actuating element does not move, in particular does not pivot, during an opening movement of the spring element, i.e. when the spring element is transferred from the closed position into the open position by a pivot movement of the spring element. The actuating element thus substantially remains in position during an opening movement of the spring element. In this case, the open position of the spring element is the completely open position of the spring element, in which the spring element is in its final position. This ensures that when the spring element is transferred from the closed position into the open position, the movement of the spring element is uncoupled from the movement of the actuating element, thereby preventing an uncontrolled movement of the actuating element that is normally initiated by the movement of the spring element, and it thus being possible to reduce to a minimum the risk of injury to the user as a result of an unexpected rotational movement of the actuating element. To achieve this, the actuating element, which is arranged in the housing preferably above the spring element, comprises a clearance (which can also be termed a recess or cut out) which is adapted to the spring element and is formed to be so large as to allow the spring element to be pivoted so far inside the clearance that said spring element is in a final position when in the completely open position, without triggering a movement of the actuating element in the process. The spring element is preferably formed as a leg spring comprising a clamping leg and an actuating leg, the actuating leg having, at its end remote from the clamping leg, a holding portion which is bent towards the clamping leg and by means of which the spring element, when in the closed position, locks on a holding element formed on the busbar or the housing. When the spring element is pivoted from the closed position into the open position, in particular the holding portion and also part of the actuating leg of the spring element enter the clearance in the actuating element. When the spring element is opened, the holding portion of the spring element is first released from its lock by means of the actuating arm of the actuating element, although there is still no pivot movement of the spring element in this case. Once the holding portion of the spring element has been released from the lock by the actuating element, despite the pivot movement of the spring element, the actuating element is not moved further, in particular is not rotated, until the spring element is in its completely open position. In particular if a large clamping force is exerted when clamping a connector having a large connector cross section, it is advantageous for the forces to now no longer be transmitted to the actuating element and thus to the tool, which is arranged in the actuating element, when the conductor is released and thus when the spring element is transferred from the closed position into the open position by the pivot movement of the spring element, but rather, in accordance with the solution according to the invention, the holding portion of the spring element is merely released from its lock by means of the actuating element or the actuating arm of the actuating element and then the spring element can "jump", i.e. can be pivoted, into the untensioned, open position, in that said spring element enters the clearance in the actuating element without the actuating element itself being moved. Unlike the known connection terminals, in this case there is no coupling of the movement between the actuating element and the spring element during a pivot movement of the spring element for opening the spring element. This produces improved operating comfort for the user when using the electrical connection terminal, since high restoring forces of the spring element now no longer act on the actuating element and thus not on the tool for actuating the actuating element either, whereby the risk of injury to the user can be reduced. In addition, by forming a clearance in the actuating element, there is no need for an additional component to achieve the uncoupling between the actuating element and the spring element.

According to a preferred configuration of the invention, the spring element comprises at least one restoring spring portion, by means of which the spring element can be automatically transferred from the closed position into the open position. As soon as the holding portion of the spring element is released from the lock in the closed position, the restoring spring portion causes the spring element to pivot into the open position without additional aid or means. For this purpose, the restoring spring portion is tensioned when the spring element is in the closed position, in that the restoring spring portion is pushed against an element, preferably a plate which, for example, is a part of the busbar. When the spring element is transferred into the closed position and into the open position, the restoring spring portion is moved, in particular displaced, on the plate. A guide element which engages in and guides the restoring spring portion on the plate can be formed on the housing. Owing to the restoring spring portion, is it also possible to transfer the spring element from the closed position into the open position without there being a conductor connected or clamped. The restoring spring portion is preferably in the form of a spring arm which extends between the actuating leg and the clamping leg and is preferably attached to the actuating leg. The spring element can comprise one restoring spring portion or two or more restoring spring portions which are preferably arranged in parallel at a certain distance from one another.

Another preferred configuration of the invention provides that the spring element is formed as a spring assembly comprising two or more springs, the springs each projecting into the conductor insertion opening by different amounts. The springs of the spring assembly directly abut one another, so that, by using a spring assembly consisting of two or more springs, the spring force or contact force applied to the conductor to be clamped can be increased, whereby a sufficiently high contact force can be applied for secure clamping, even for large conductor cross sections. To additionally allow conductors having a small conductor cross section to be directly plugged, the springs of the spring assembly each project into the conductor insertion opening by different amounts, in that the length of the clamping legs of the individual springs of the spring assembly is different. In the case of two or more springs, the springs preferably project into the conductor insertion opening with a stepped length. Conductors having a small conductor cross section are then, for example, only pressed against the busbar by one spring or a clamping leg of one spring of the spring assembly, thereby allowing the conductors to be directly plugged. In the case of conductors having a large conductor cross section, however, said conductors are pressed against the busbar by a plurality or all of the springs and thus by a plurality or all of the clamping legs of the spring assembly. The electrical connection terminal is thus suitable for conductors having different conductor cross sections. However, if the electrical connection terminal is only used for conductors having one particular conductor cross section, it is also possible for the springs of the spring assembly to each project into the conductor insertion opening by the same amount so that a particularly high contact force can be applied to the conductor to be clamped.

To prevent the actuating element from being freely movable when a conductor is clamped against the busbar by means of the spring element, in particular when the spring element is in the closed position, it is preferably provided that the actuating element comprises a locking means for holding the actuating element in a fixed position. The locking means can, for example, take the form of a pin or web which is formed on the actuating element, protrudes laterally from the actuating element, and can, for example, hook behind a holding element, for example in the form of a web or a rib, formed on the inside of the housing.

In order to be able to transfer large forces, it is also preferably provided for the actuating element to comprise a tool insertion opening for actuating the actuating element by means of a tool. The rotational movement of the actuating element can thus be brought about by means of a tool, for example a screwdriver.

The actuating element is preferably formed such that said element comprises a main body, on which the actuating arm is formed, the main body having a greater thickness than the actuating arm. Owing to the greater thickness of the main body, said body can have a particularly high degree of stability, so that large forces can be absorbed via the main body of the actuating element. A through-opening is preferably formed in the main body, by means of which opening the actuating element is rotatably mounted on a bearing journal of the housing.

In addition, it is preferably provided for the housing to comprise two conductor insertion openings and for two spring elements and two actuating elements to be arranged in the housing, the two actuating elements being rotatable in the opposite direction to one another and opposing one another such that the actuating arms of the actuating elements are arranged behind one another in the separation direction. Owing to this specific arrangement with a plurality of actuating elements in a housing of a connection terminal, the necessary construction space can be divided up in as compact a manner as possible when two conductor connections are provided, whereby the electrical connection terminal as a whole can be formed to be particularly compact.

The invention will be described in more detail below with reference to a preferred embodiment and on the basis of the accompanying drawings.

Figure 6:
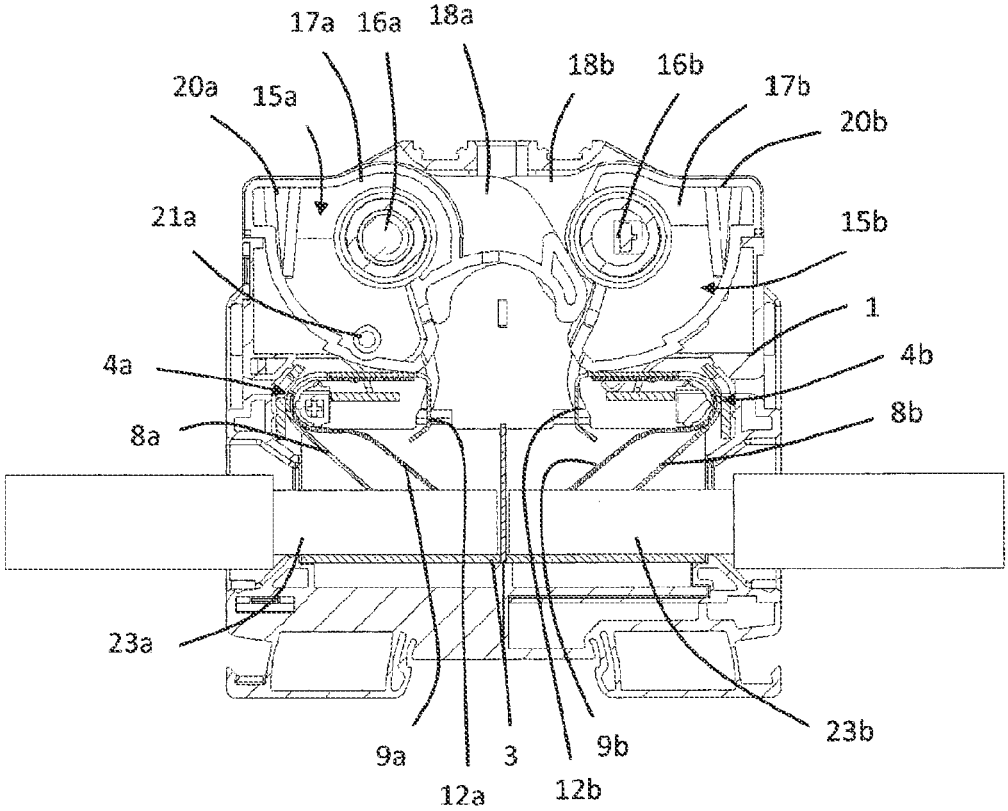
FIG. 6 is a schematic sectional view of an electrical connection terminal according to the invention with inserted conductors.

FIG. 1 is a sectional view of an electrical connection terminal according to the invention, comprising a housing 1 having a first conductor insertion opening 2*a* and a second conductor insertion opening 2*b*. A busbar 3 is arranged in the housing 1, against which busbar conductors 23*a*, 23*b* inserted into the conductor insertion openings 2*a*, 2*b*, as shown in FIG. 6, can be clamped in a contacting manner. In the embodiment shown here, the busbar 3 extends from the first conductor insertion opening 2*a* to the second conductor insertion opening 2*b*, so that the conductor 23*a* inserted into the first conductor insertion opening 2*a* is clamped in a contacting manner onto the same busbar 3 as the conductor 23*b* inserted into the second conductor insertion opening 2*b*. In the embodiment shown here, the busbar 3 is formed to be bent in a substantially U-shaped manner, as can be seen in particular in FIG. 3.

In addition, a first spring element 4*a* and a second spring element 4*b* are arranged in the housing 1, the first spring element 4*a* being arranged opposite the second spring element 4*b*. The two spring elements 4*a*, 4*b* are each rotatably mounted on a bearing journal 5*a*, 5*b*, so that the spring elements 4*a*, 4*b* can be separately transferred into a closed position and into an open position. In FIG. 1, both spring elements 4*a*, 4*b* are arranged in a closed position.

Here, the spring elements 4*a*, 4*b* are each formed as a spring assembly comprising a first spring 6*a*, 6*b* and a second spring 7*a*, 7*b*. In this case, the second spring 7*a*, 7*b* abuts the inner surface of the first spring 6*a*, 6*b*. Both springs 6*a*, 6*b*, 7*a*, 7*b* are formed as leg springs which comprise a clamping leg 8*a*, 8*b*, 9*a*, 9*b* and an actuating leg 10*a*, 10*b*, 11*a*, 11*b*. By means of the clamping leg 8*a*, 8*b*, 9*a*, 9*b*, a conductor 23*a*, 23*b* inserted into the conductor insertion opening 2*a*, 2*b* can be clamped against the busbar 3. In this case, the clamping leg 9*a*, 9*b* of the second, inner spring 7*a*, 7*b* is longer than the clamping leg 8*a*, 8*b* of the first, outer spring 6*a*, 6*b*, so that, when clamping conductors 23*a*, 23*b* having a small conductor cross section, these are only clamped against the busbar 3 by means of the clamping leg 9*a*, 9*b* of the second spring 7*a*, 7*b*, and when clamping conductors 23*a*, 23*b* having a large conductor cross section, these are clamped against the busbar 3 by means of the clamping leg 8*a*, 8*b* of the first spring 6*a*, 6*b* and the clamping leg 9*a*, 9*b* of the second spring 7*a*, 7*b*.

A holding portion 12*a*, 12*b*, which is bent towards the clamping leg 8*a*, 8*b*, is formed on the actuating leg 10*a*, 10*b*, at the end thereof remote from the clamping leg 8*a*, 8*b*, of the first spring 6*a*, 6*b*, which actuating leg is longer than the actuating leg 11*a*, 11*b* of the second spring 7*a*, 7*b*, by means of which holding portion the first spring 6*a*, 6*b* and thus the spring element 4*a*, 4*b* formed as a spring assembly can, when in the closed position, lock on a holding element formed on the busbar 3 or on the housing 1.

Figure 5:
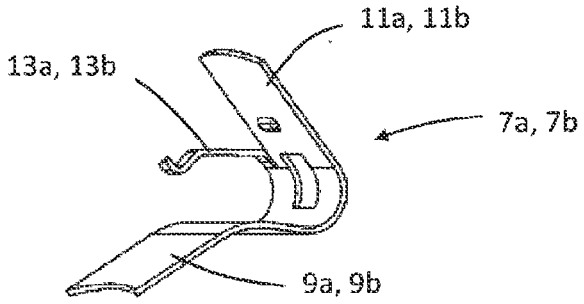
FIG. 5 is a schematic view of a spring element of the electrical connection terminal according to the invention.

FIG. 5 shows the second spring 7*a*, 7*b* of the spring element 4*a*, 4*b*, formed as a spring assembly, separately in more detail, it being possible to see here that the second spring 7*a*, 7*b* comprises a restoring spring portion 13*a*, 13*b* in the form of a spring arm which extends between the actuating leg 11*a*, 11*b* and the clamping leg 9*a*, 9*b* and is attached to the actuating leg 11*a*, 11*b*. The restoring spring portion 13*a*, 13*b* has a substantially smaller width than the actuating leg 11*a*, 13*b*.

When the spring elements 4*a*, 4*b* are in the closed position, as shown in FIG. 1, the restoring spring portion 13*a*, 13*b* is "tensioned", which means that the restoring spring portion 13*a*, 13*b* is bent towards the actuating leg 11*a*, 11*b*, so that the restoring spring portion 13*a*, 13*b* is arranged substantially parallel to the actuating leg 11*a*, 11*b*. Here, the restoring spring portion 13*a*, 13*b* is pressed against a plate 14*a*, 14*b*, which in this case is a part of the busbar 3.

Figure 2:
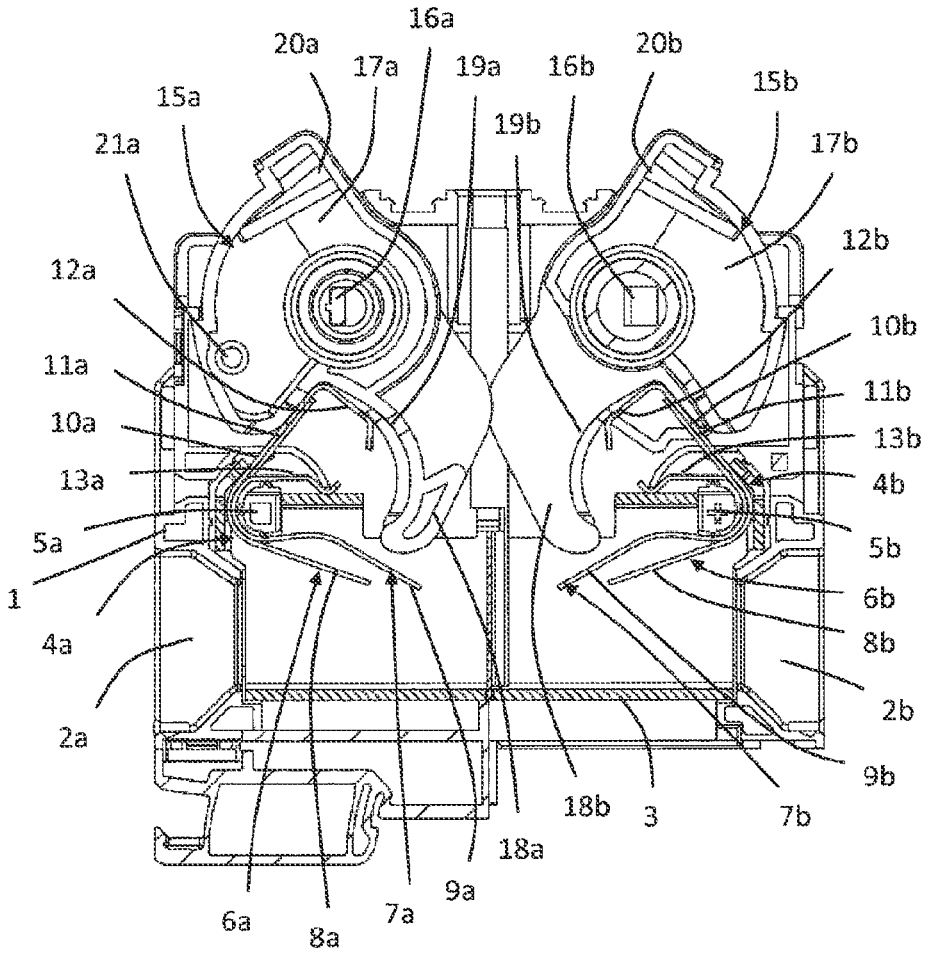
FIG. 2 is another schematic sectional view of the electrical connection terminal according to the invention.

FIG. 5 shows the restoring spring portion 13*a*, 13*b* in a "non-tensioned" state, in which the spring element 4*a*, 4*b* is arranged in an open position, as also shown in FIG. 2. Here, the restoring spring portion 13*a*, 13*b* is arranged on a side face of the spring 7*a*, 7*b*. It can, however, be arranged along the width of the spring 7*a*, 7*b*, for example in the centre. In addition, it is also possible to provide two or more restoring spring portions 13*a*, 13*b* on one spring 7*a*, 7*b*, said restoring spring portions then preferably being arranged in parallel at a distance from one another, it being possible, for example, for a first restoring spring portion to be arranged on a first side face of the spring and a second restoring spring portion to be arranged on a second side face of the spring opposite the first side face.

To actuate the spring elements 4*a*, 4*b* and thus the spring assemblies, two actuating elements 15*a*, 15*b* formed as eccentrics are additionally arranged in the housing 1. The actuating elements 15*a*, 15*b* are mounted so to be rotatable in the housing 1 by means of bearing journals 16*a*, 16*b*. As can be seen in particular in FIG. 3, the actuating elements 15*a*, 15*b* comprise a main body 17*a*, 17*b* and an actuating arm 18*a*, 18*b* which is formed integrally on the main body 17*a*, 17*b* and has a lower thickness than the main body 17*a*, 17*b*. The actuating arm 18*a*, 18*b* is bent towards the spring element 4*a*, 4*b* and is used to release the holding portion 12*a*, 12*b* of the spring element 4*a*, 4*b* from its lock when the spring element 4*a*, 4*b* is to be transferred from the closed position into the open position, in that the holding portion 12*a*, 12*b* is bent towards the actuating leg 10*a*, 10*b*, 11*a*, 11*b* by means of the actuating arm 18*a*, 18*b*, as shown on the right-hand side of the connection terminal in FIG. 1. As soon as the holding portion 12*a*, 12*b* is released from the lock, the spring element 4*a*, 4*b* can pivot upwards towards the actuating element 15*a*, 15*b*, in that the spring element 4*a*, 4*b* pivots, together with the holding portion 12*a*, 12 and at least a part of the actuating leg 10*a*, 10*b*, 11*a*, 11*b* into a clearance 19*a*, 19*b* formed in the actuating element 15*a*, 15*b*, without triggering a rotational movement of the actuating element 15*a*, 15*b*, as shown in FIG. 2.

To transfer the spring element 4*a*, 4*b* from the open position back into the closed position, the actuating element 15*a*, 15*b* is rotated such that it is pressed, preferably with the main body 17*a*, 17*b* thereof, against the actuating leg 10*a*, 10*b*, 11*a*, 11*b* of the spring element 4*a*, 4*b* so as to push said actuating leg downwards.

The actuating element 15*a*, 15*b* can be moved in a rotational manner by means of a tool, in particular a screwdriver, in that said tool is inserted into a tool insertion opening 20*a*, 20*b* formed in the actuating element 15*a*, 15*b*, the tool insertion opening 20*a*, 20*b* being formed in the main body 17*a*, 17*b* of the actuating element 15*a*, 15*b*.

Figure 3:
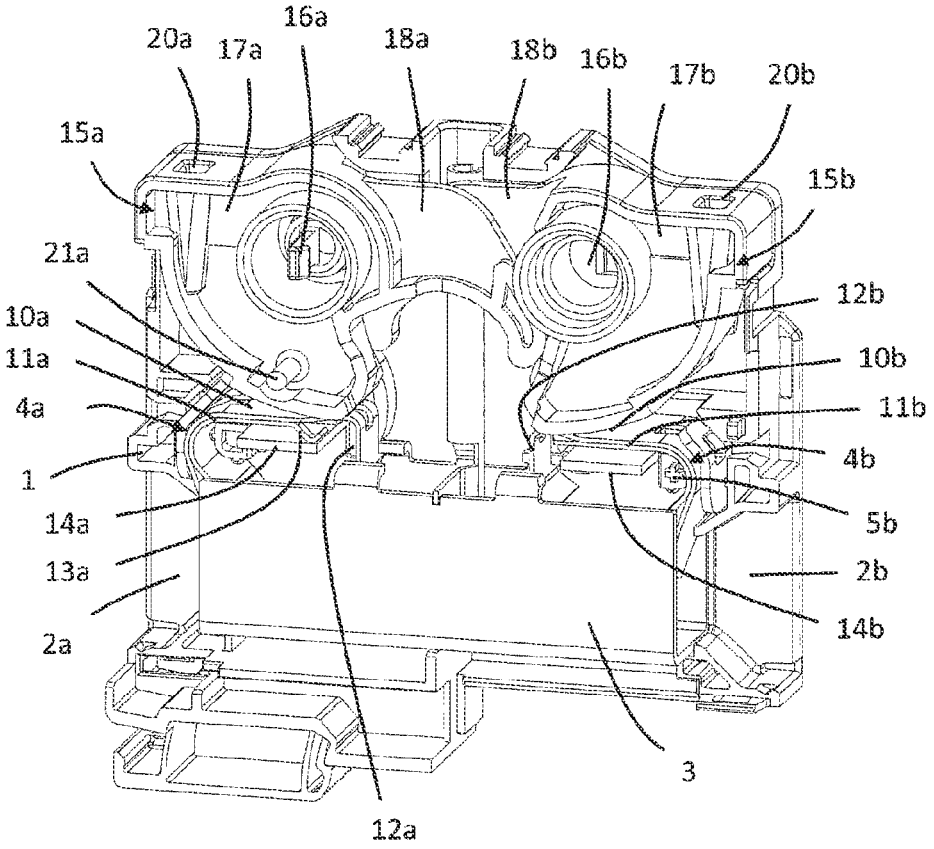
FIG. 3 is another schematic sectional view of the electrical connection terminal according to the invention.

To hold the actuating elements 15*a*, 15*b* in a fixed position, in particular when the spring elements 4*a*, 4*b* are in the closed position, the actuating elements 15*a*, 15*b* comprise a locking means 21*a*, as shown in FIG. 3, it being possible to see only the locking means 21*a* on the left-hand actuating element 15*a* in this figure, by means of which locking means the actuating elements 15*a*, 15*b* can be fixed relative to the housing 1 independently of one another. The locking means 15*a* here is in the form of a pin that is integrally formed on the main body 17*a* of the actuating element 15*a* in that said pin protrudes vertically from the side face of the actuating element 15*a*. To the hold the actuating element 15*a* in a fixed position, the locking means 21*a* can, for example, hook behind a holding element, for example in the form of a web or a rib, formed on the inside of the housing 1. This hooking can preferably be released by means of a tool, so that the actuating element 15*a* is freely movable again, for example in order to release the spring element 4*a* from the lock of the closed position by actuating the holding portion 12*a* of the spring element 4*a*.

In the embodiment shown in FIGS. 1-4 and 6, the electrical connection terminal comprises a housing 1 having two opposite conductor insertion openings 2*a*, 2*b*, two opposite spring elements 4*a*, 4*b*, and two opposite actuating elements 15*a*, 15*b*. A conductor 23*a*, 23*b* can be inserted into each of the conductor insertion openings 2*a*, 2*b* so that two conductors 23*a*, 23*b* can be clamped against a busbar 3 at the same time by means of one connection terminal. The two actuating elements 15*a*, 15*b* and also the two spring elements 4*a*, 4*b* can be actuated or moved separately from one another. In this case, the two actuating elements 15*a*, 15*b* are rotatable in opposite directions to one another and oppose one another such that the actuating arms 18*a*, 18*b* of the actuating elements 15*a*, 15*b* are arranged one behind the other in the separation direction.

FIG. 1 shows the spring element 4*a* on the left-hand side in a closed position and the actuating arm 18*a* of the actuating element 15*a* arranged on the left-hand side is rotated away from the spring element 4*a*, so that said arm is behind the actuating element 15*b* arranged on the right-hand side, and thus cannot be seen in FIG. 1. Here, the actuating element 15*a* on the left-hand side is held in a fixed position by means of the locking means 21*a*. The spring element 4*b* on the right-hand side is likewise arranged in the closed position, although here the actuating arm 18*b* of the actuating element 15*b* arranged on the right-hand side presses on the holding portion 12*b* of the spring element 4*b* and thus bends said portion towards the actuating leg 10*b*, 11*b* in order to release the spring element 4*b* from the lock in the closed position.

FIG. 2 shows both spring elements 4*a*, 4*b* in an open position, in which the actuating leg 10*a*, 10*b*, 11*a*, 11*b* and the holding portion 12*a*, 12*b* of the spring arms 4*a*, 4*b* are pivoted into the clearance 19*a*, 19*b* formed in the actuating elements 15*a*, 15*b*.

In FIG. 3, both spring elements 4*a*, 4*b* are arranged in the closed position, and the actuating arms 18*a*, 18*b* of the actuating elements 15*a*, 15*b* are pivoted away from the spring elements 4*a*, 4*b* and the actuating elements 15*a*, 15*b* are held in the fixed position by means of the locking means 21*a*.

In FIG. 6, the spring elements 4*a*, 4*b* and the actuating elements 15*a*, 15*b* are in the same position as in FIG. 3, FIG. 6 also showing that two conductors 23*a*, 23*b* are inserted into the conductor insertion openings 2*a*, 2*b* and clamped here against the busbar 3 by means of the spring elements 4*a*, 4*b*.

Figure 4:
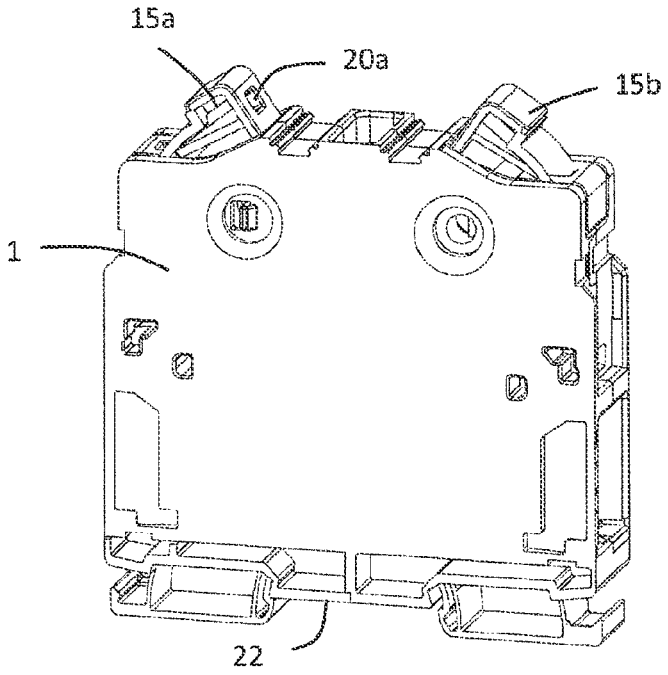
FIG. 4 is a schematic view of the electrical connection terminal according to the invention.

FIG. 4 is a non-sectional view of the connection terminal. A base element 22 is formed integrally on the underside of the housing 1, by means of which base element the connection terminal can be locked onto a mounting rail or a top-hat rail.

In this context, the design of the connection terminal is not limited to the embodiment shown here having two conductor insertion openings 2*a*, 2*b*, two spring elements 4*a*, 4*b* and two actuating elements 15*a*, 15*b*. It is also possible for the connection terminal to be formed having either one or more than two conductor insertion openings 2*a*, 2*b*, spring elements 4*a*, 4*b* and actuating elements 15*a*, 15*b*.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B and C" should be interpreted as one or more of a group of elements consisting of A, B and C, and should not be interpreted as requiring at least one of each of the listed elements A, B and C, regardless of whether A, B and C are related as categories or otherwise. Moreover, the recitation of "A, B and/or C" or "at least one of A, B or C" should be interpreted as including any singular entity from the listed elements, e.g., A, any subset from the listed elements, e.g., A and B, or the entire list of elements A, B and C.

LIST OF REFERENCE NUMERALS housing 1
conductor insertion opening 2*a*, 2*b*
busbar 3
spring element 4*a*, 4*b*
bearing journal 5*a*, 5*b*
first spring 6*a*, 6*b*
second spring 7*a*, 7*b*
clamping leg 8*a*, 8*b*, 9*a*, 9*b*
actuating leg 10*a*, 10*b*, 11*a*, 11*b*
holding portion 12*a*, 12*b*
restoring spring portion 13*a*, 13*b*
plate 14*a*, 14*b*
actuating element 15*a*, 15*b*
bearing journal 16*a*, 16*b*
main body 17*a*, 17*b*
actuating arm 18*a*, 18*b*
clearance 19*a*, 19*b*
tool insertion opening 20*a*, 20*b*
locking means 21*a*
base element 22
conductor 23*a*, 23*b*

The invention claimed is:

1. An electrical connection terminal, comprising:
a housing having a conductor insertion opening;
a busbar disposed in the housing;

a spring element which is rotatably mounted in the housing and is pivotable into an open position and into a closed position, wherein, in the closed position, a conductor inserted into the conductor insertion opening is clampable against the busbar via the spring element; and an actuating element, which is rotatably mounted in the housing, that comprises an actuating arm via which the spring element is configured to be actuated so as to be transferred into the open position and into the closed position;

wherein the actuating element comprises a clearance which is adapted to the spring element and into which the spring element is configured to pivot during a pivot movement from the closed position into the open position, without triggering a rotational movement of the actuating element.

2. The electrical connection terminal according to claim 1, wherein the spring element comprises at least one restoring spring portion via which the spring element is configured to be automatically transferred from the closed position into the open position.

3. The electrical connection terminal according to claim 1, wherein the spring element is formed as a spring assembly comprising at least two springs, the springs projecting into the conductor insertion opening by different amounts.

4. The electrical connection terminal according to claim 1, wherein the actuating element comprises a locking mechanism for holding the actuating element in a fixed position.

5. The electrical connection terminal according to claim 1, wherein the actuating element comprises a tool insertion opening for actuating the actuating element via a tool.

6. The electrical connection terminal according to claim 1, wherein the actuating element comprises a main body on which the actuating arm is formed, the main body having a greater thickness than the actuating arm.

7. The electrical connection terminal according to claim 1, wherein the housing comprises two conductor insertion openings, and two spring elements and two actuating elements are disposed in the housing, the two actuating elements being rotatable in opposite directions to one another and opposing each other such that the actuating arms of the actuating elements are disposed one behind the other in a separation direction.

* * * * *